US006152041A

United States Patent [19]

Harris et al.

[11] Patent Number: 6,152,041

[45] Date of Patent: Nov. 28, 2000

[54] DEVICE FOR EXTENDING THE RANGE OF GUIDED BOMBS

[75] Inventors: Gordon L. Harris, Rancho Santa Fe; Neil A. Levy, Encinitas, both of Calif.

[73] Assignee: Leigh Aerosystems Corporation, Carlsbad, Calif.

[21] Appl. No.: 09/197,965

[22] Filed: Nov. 23, 1998

Related U.S. Application Data

[60] Provisional application No. 60/087,127, May 29, 1998.

[51] Int. Cl.[7] ..... F42B 10/14; F42B 10/38

[52] U.S. Cl. ..... 102/384; 244/3.25

[58] Field of Search ..... 244/3.25, 3.28; 102/384, 490

[56] References Cited

U.S. PATENT DOCUMENTS 2,992,794 7/1961 Boyd ..... 102/384

4,296,894 10/1981 Schnabele et al. ..... 102/384

5,141,175 8/1992 Harris ..... 102/384

*Primary Examiner*—Thomas Price

*Attorney, Agent, or Firm*—Edward A. Sokolski

[57] ABSTRACT

A guided bomb is provided with a central hardback section having a pair of extensible wings pivotally attached thereto. The hardback section is attached to the bomb by a saddle member. After launch of the bomb from the aircraft, the wings are extended by means of an electric motor and gear train to provide the lift necessary for gliding flight. One or more ailerons are provided on the trailing edges of the wings to enable control of the flight, these ailerons being controlled by the bomb's resident guidance system. The geometry of the wings, the hardback section and saddle member are designed so that the guided bomb units can be fitted within a restricted space on bomber aircraft rotary launchers.

12 Claims, 8 Drawing Sheets

DEVICE FOR EXTENDING THE RANGE OF GUIDED BOMBS

This application is based on a Provisional Application No. 60/087,127 filed May 29, 1998.

BACKGROUND OF THE INVENTION

1. Field of the Invention

This invention relates to air launched guided bombs and more particularly to a mounting device for an aerodynamic wing for use in extending the range of such guided bombs.

2. Description of the Related Art

Guided bombs of the 2000 lb class include the MK-84 general purpose bomb and BLU-109 and BLU-116 penetrator bombs whose fixed tail sections have been replaced by tail sections housing a guidance and control unit. Guidance is provided by a GPS aided inertial navigation system coupled to a set of servo actuators controlling the tail fins. The most common bomb of this class is known as a Joint Direct Attack Munition(JDAM). These weapons are especially important for use in modern bombers whose weapon bays contain rotary launchers. The use of a guided tail allows accurate delivery of "dumb" bombs in the current inventory. However, accurate delivery of the bomb is still accomplished in a direct attack mode with virtually no additional stand off from the target so that the delivery aircraft has no increase in protection from enemy fire.

Such additional stand off protection can be achieved by fitting the bomb with a wing device which provides significant lift capability, allowing the bomb to guide to the target area from a long stand off range. Several types of wing adapter kits have been developed in the prior art. One such device is the Leigh Aerosystems LONGSHOT wing adapter kit, which is the subject of U.S. Pat. No. 5,141,175 issued Aug. 25, 1992 to Gordon L. Harris. Other manufacturers have also developed wing adapter kits having different configurations to accomplish this same objective. However, no known prior art wing mounting device has the capability of fitting within the relatively confined space available in the weapons bay of modern bombers with rotary launchers, such that a full load out of 2000 lb class guided bombs can be accommodated.

SUMMARY OF THE INVENTION

The device of the present invention overcomes the aforementioned shortcomings of the prior art by utilizing a wing geometry which enables the bomb units to fit within the restricted space available around the rotary launcher while satisfying the requirements for controlled flight and target impact. The device of the invention comprises a wing adapter kit which provides range extension for 2000 lb. class guided bombs using general purpose or penetrator warheads. This device is designed to satisfy the unique requirements associated with the carriage in and launch from rotary launchers in the weapon bays of modern bombers. The device of the invention is also suitable for external carriage on fighter aircraft.

The device of the invention comprises a central hardback section to which a pair of wings are pivotally attached. After launch of the bomb, an electric motor, operating in conjunction with a gear train, extends the wings to provide the lift necessary for gliding flight. The hardback section is attached to the bomb by means of a saddle member which runs around the bomb and engages one or more suspension lugs on the bomb. When the saddle member is tightened down against the bomb, movement thereof relative to the bomb is prevented. The wings may have one or more ailerons on their trailing edges to assure that the bomb is fully controllable throughout the flight from launch through the ingress and terminal phases. The motion of the ailerons is controlled by the bomb's guidance unit through an interface contained in the wing adapter kit. The special requirements of penetrator bombs during the terminal phase of flight are also handled to ensure alignment of the bomb body with its velocity vector at vertical or near vertical at the moment of target impact.

It is therefore an object of this invention to enable a wing range extender for a guided bomb to fit within the restricted space available within the weapon bays of bomber aircraft having rotary launchers.

Other objects of the invention will become apparent in view of the following description taken in connection with the accompanying drawings.

DETAILED DESCRIPTION OF THE INVENTION

Figure 1:
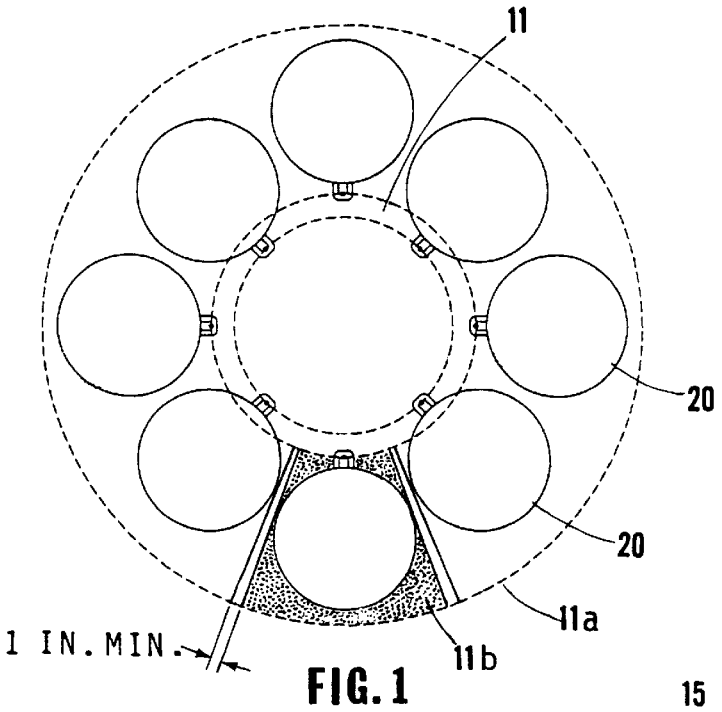
FIG. 1 is a schematic view of a typical rotary launcher showing a full complement of Mk84 bombs installed therein.

Referring to FIG. 1, eight MK-84 general purpose bombs are shown loaded on a rotary launcher 11. Because of the surrounding weapon bay geometry, no part of the weapon can extend outside the 38 inch radius circle 11*a*. It can be seen that there is little room remaining for wing adapter kits to be added. This same situation exists for B-1B, B-2, and B-52 weapon bays containing rotary launchers. The space available in which to add a wing adapter kit is indicated by the stippled area 11*b*. This area also accounts for the minimum spacing of one inch between adjacent weapons to allow for the use of hand tools during the loading process.

Figure 2:
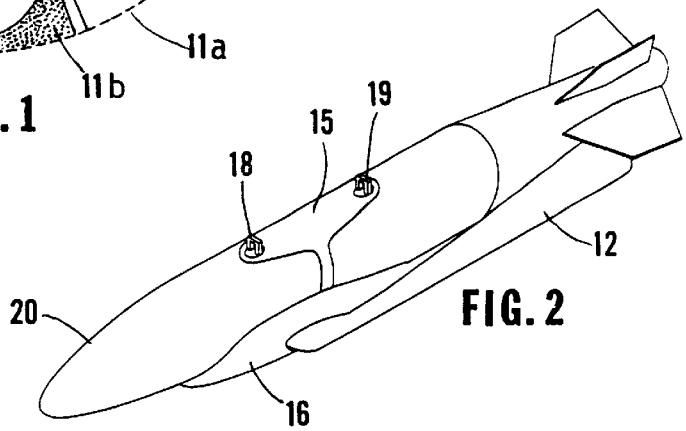
FIG. 2 is a top perspective view showing a first embodiment of the invention with the wings stowed for carriage.
Figure 2A:
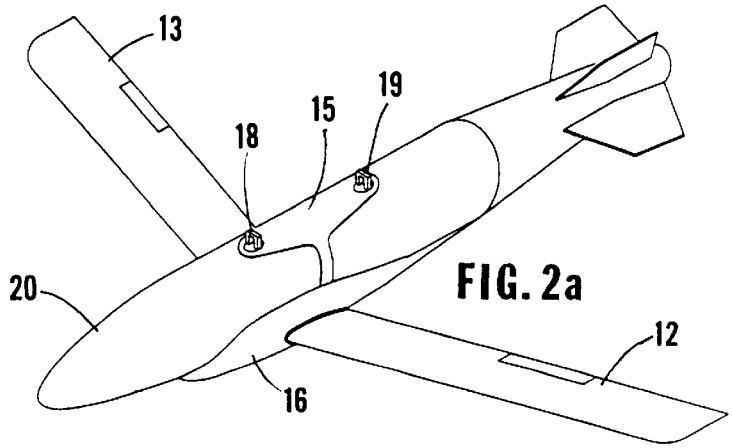
FIG. 2A is a top perspective view showing the embodiment of FIG. 2 with the wings extended for flight.
Figure 5:
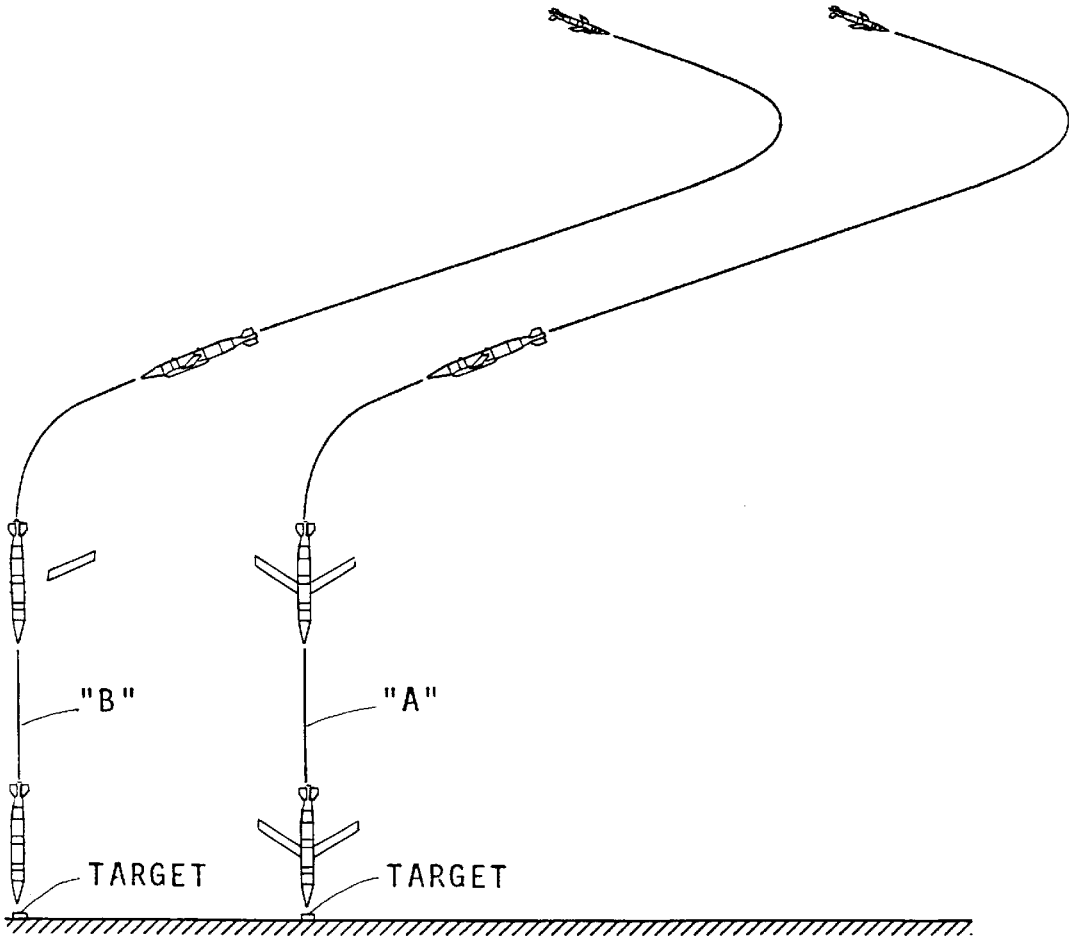
FIG. 5 is a diagram illustrating the operational flight profiles of the device of the invention.

Referring now to FIGS. 2, 2*a*, and 5, the operation of the device of the invention is illustrated. The wings 12 and 13 are held to the bomb 20 by means of saddle member 15 and while being carried are in their retracted position, as shown in FIG. 2. When the bomb is launched, the wings 12 and 13 are extended as shown in FIG. 2*a* and so maintained throughout the flight path "A" as shown in FIG. 5 or kept extended until the bomb is directly over the target and then shed as illustrated in flight path "B" of FIG. 5.

Figure 3:
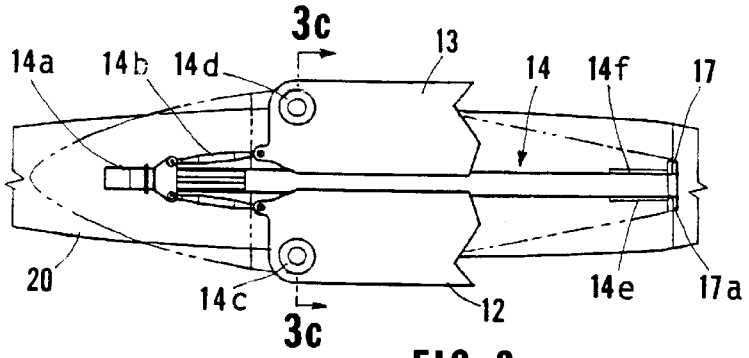
FIG. 3 is a bottom plan view of the first embodiment showing the hardback member and the wing drive mechanism with the wings stowed for carriage.
Figure 3C:
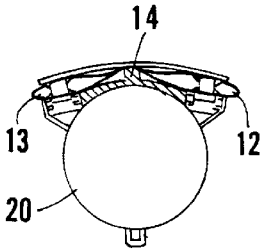
FIG. 3*c* is a cross sectional view taken along the plane indicated by 3*c*—3*c* in FIG. 3.
Figure 3A:
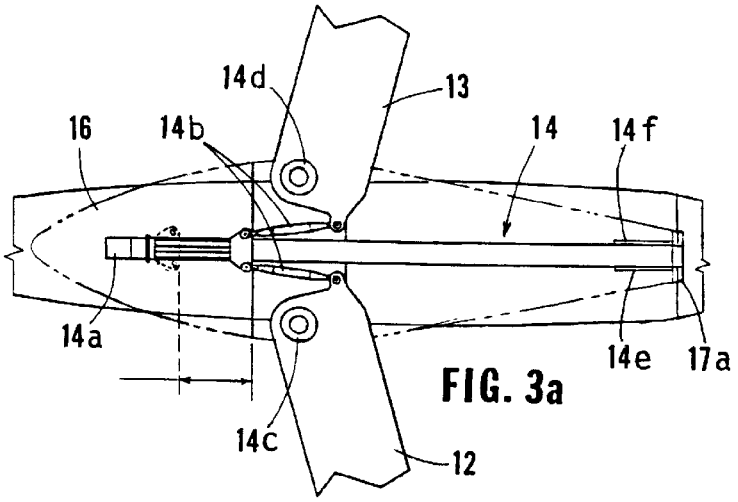
FIG. 3*a* is a bottom plan view of the first embodiment showing the wings extended for flight.
Figure 3D:
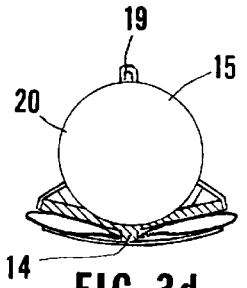
FIG. 3*d* is a cross sectional view taken along the plane indicated by 3*d*—3*d* in FIG. 3*b*.
Figure 3B:
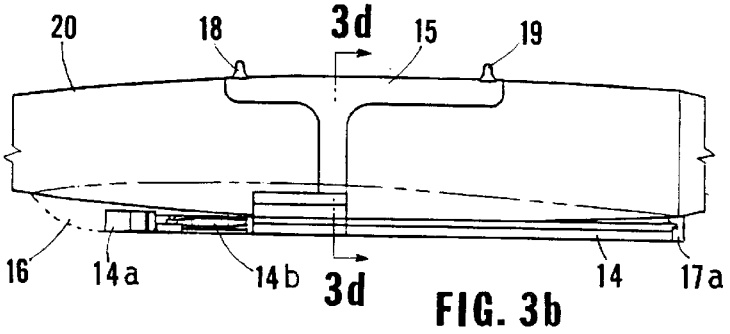
FIG. 3*b* is a side elevational view of the first embodiment with the wings omitted.
Figure 3E:
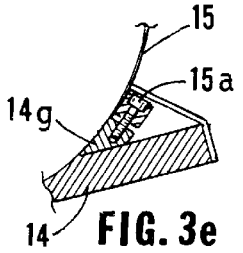
FIG. 3*e* is a side elevational view of the saddle tensioning bolt of the first embodiment.
Figure 3F:
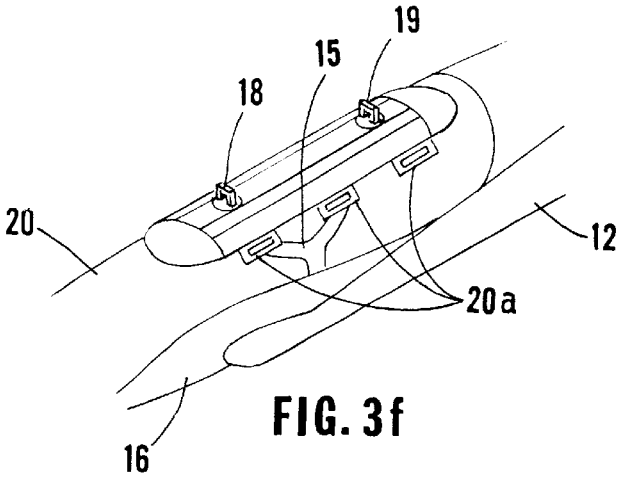
FIG. 3*f* is a top perspective view illustrating a device for attaching the saddle member to the bomb.
Figure 3G:
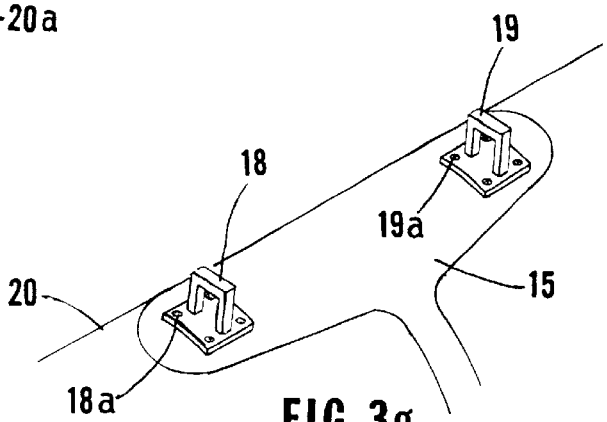
FIG. 3*g* is a top perspective view illustrating another device for attaching the saddle member to the bomb.

Referring now to FIGS. 3, and 3*a*–3*d*, a first embodiment of the invention is illustrated. Wing drive mechanism 14*a* provides the force necessary to drive the wings 12 and 13 to the extended flight position as shown in FIG. 3*a*. The wings are driven about pivots 14*c* and 14*d* which extend from hardback member 14. Drive mechanism 14*a* may comprise a spring, motor or other device which drives the wings through linkage 14*b* which is attached to the wings. Hardback member 14 is attached to the underside of the bomb 20 by means of saddle member 15 which has a tensioning bolt 15*a* for clamping the saddle to the lug 14*g* of hardback member 14, as shown in FIG. 3*e*. To minimize stress buildup in the saddle member, the tensioning bolt 15*a* is oriented parallel to a tangent to the body of the bomb, a normal to this tangent intersecting a point where the saddle member contacts lug 14*g*. For general purpose bombs, the saddle member has circular cutouts which surround the bomb's threaded suspension lugs 18 and 19 in snug relationship to prevent rotation of the saddle due to torsional forces, as shown in FIG. 3*b*. The saddle member for other bombs may be configured to engage existing slots 20*a* formed in the bomb as shown in FIG. 3*f* and is clamped to the bomb as shown in FIG. 3*e*. For bombs with bolted on suspension lugs, the saddle member may be installed underneath the lugs 18 and 19 and bolted in position by means of bolts 18*a* and 19*a* as shown in FIG. 3*g*. Aerodynamic fairing 16 is attached to hardback member 14. The saddle member and the hardback member may be of stainless steel.

The aft portion of hardback member 14 has two plates 14*e* and 14*f* attached thereto. The rear portions of these plates are in the shape of hooks which are installed in vertical slots formed in anchor block 17 which is attached to bomb 20 at the junction of the main body of the bomb and its tail section. Pivot shaft 17*a* is installed in anchor block 17 perpendicular to the vertical slots so that it is in contact with the hooked portions of plates 14*e* and 14*f*. The hardback member and the wings attached thereto may be jettisoned from the bomb during free flight by releasing the saddle member 15 by means of mechanical, electromechanical, or explosive means. It is to be noted that during separation, the lift on the wings causes the device to be rotated rearwardly about pivot shaft 17*a* ensuring that it does not strike the tail section of the bomb before separating.

Figure 4:
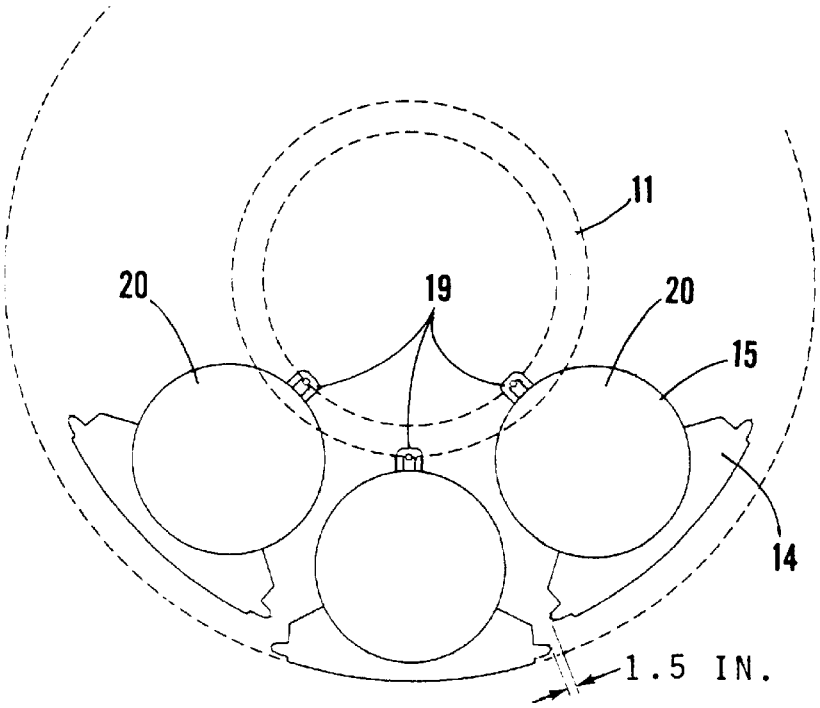
FIG. 4 is a diagrammatic view of a rotary launcher illustrating the fitting of the first embodiment into the available space.

FIG. 4 is a schematic illustration showing bombs 20 mounted in the rotary launcher 11 of an aircraft by means of suspension lugs 19. As can be seen, in view of the unique configuration of the wing adapter kit of the invention, a full load of bombs can be accommodated in the launcher.

Referring now to FIG. 5, the operation of the weapon with which the device of the invention is utilized is schematically illustrated. The weapon, which may be a 2000 lb class guided bomb to which the wing adapter kit of the invention is attached, is typically launched from an aircraft at an altitude of about 30,000 ft at about 0.8 Mach. To achieve maximum range, the air speed that will give maximum lift to drag ratio is sought. During the launch and glide phases of the mission, in order to sustain equilibrium and accommodate maneuvers, it is necessary to generate sufficient lift throughout the altitude and Mach number envelope. With this condition met, the weapon glides to a pre-selected point above and up range of the target, where as shown in FIG. 5, it performs a pitch-over maneuver resulting in a vertical or near vertical dive to the target. During the period of this dive, the velocity vector is aligned with the body of the weapon. This means that the angle of the relative airflow to the weapon body is essentially zero when the lift is at or near zero. This condition is met whether or not the wing adapter kit is jettisoned from the bomb. The "A" flight shows a weapon in which the wing adapter kit is not jettisoned while the "B" flight shows a weapon in which such kit is jettisoned.

In order to assure proper flight of the weapon, the wing pivot axis, i.e. the axis about which the wings rotate when they are driven to the extended position, may have to be angulated a predetermined amount to provide the desired aerodynamic characteristics during the flight. The amount of such angulation will vary depending on the characteristics of the weapon involved. This factor must be considered when designing the device to fit within the available aircraft stowage space. The several embodiments of the invention illustrated schematically in FIGS. 6–9 are designed with these considerations in mind.

Figure 6:
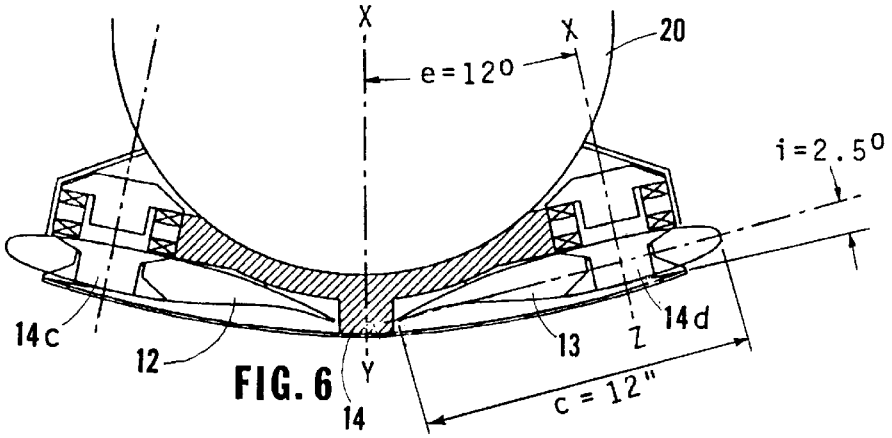
FIG. 6 is an enlarged schematic cutaway sectional view of the drawing shown in FIG. 3*d*.
Figure 6B:
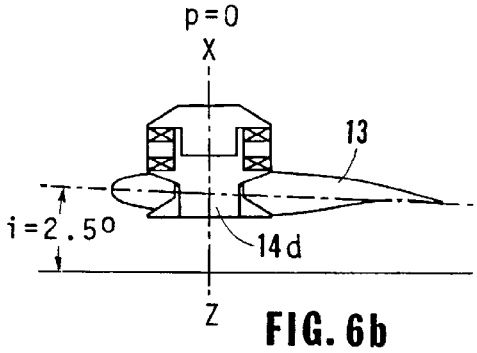
FIG. 6*b* is a cross sectional view taken along the plane indicated by 6*b*—6*b* in FIG. 6*a*.
Figure 6A:
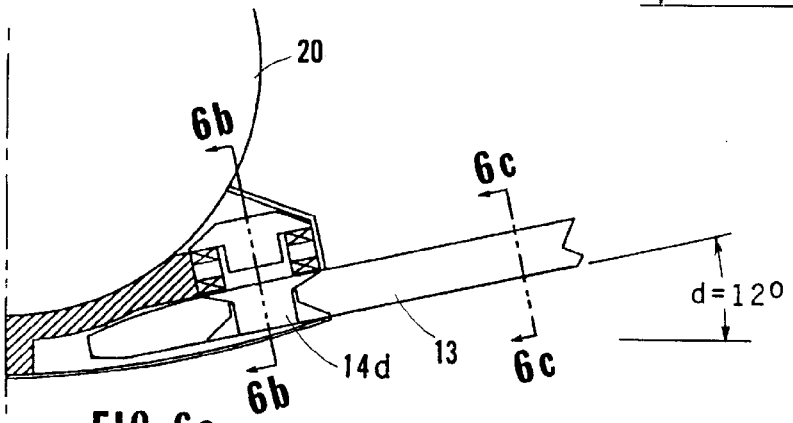
FIG. 6*a* is a cutaway section showing a portion of the hardback member of the first embodiment.
Figure 6C:
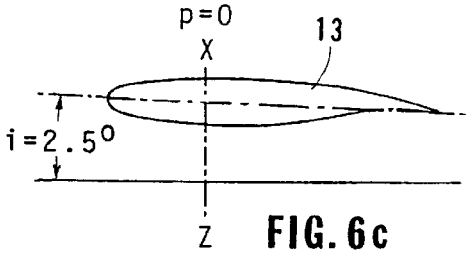
FIG. 6*c* is a view taken along the plane indicated by 6*c*—6*c* in FIG. 6*a*.

Referring to FIGS. 6, 6*a*, 6*b*, and 6*c*, the first embodiment of the invention is shown. In this embodiment, the angle of the pivot axes(p) of the wings on pivots 14*c* and 14*d* coincide with the axis "x-z" which is normal to the longitudinal axis of the wings 12 and 13. In this embodiment, the angle(i) between the wing chord and an axis normal to axis "x-z" is the same with the wing stowed as shown in FIG. 6 and when extended for flight as shown in FIGS. 6*a*–6*c*. Typically, the angle "i" is 2.5 degrees. This configuration makes for optimum stowage in the aircraft but with the wings fully extended presents a performance limitation with penetrator bombs. This limitation is removed, however, by sweeping the wings back sufficiently to allow the longitudinal axis of the bomb to align with its velocity vector at steep dive angles. It is to be noted that a positive value of "i" combined with the camber effect of the airfoil produces high lift when the body angle is zero. Also, the angle(e) between the vertical axis "X-Y" and the pivot axis "X-Z" with the wing stowed, as shown in FIG. 6 is numerically equal to the dihedral angle "d" with the wing extended, as shown in FIG. 6*a*. Angle "d" is typically in the range of 8–12 degrees with a wing having a width of 12 inches.

Figure 7:
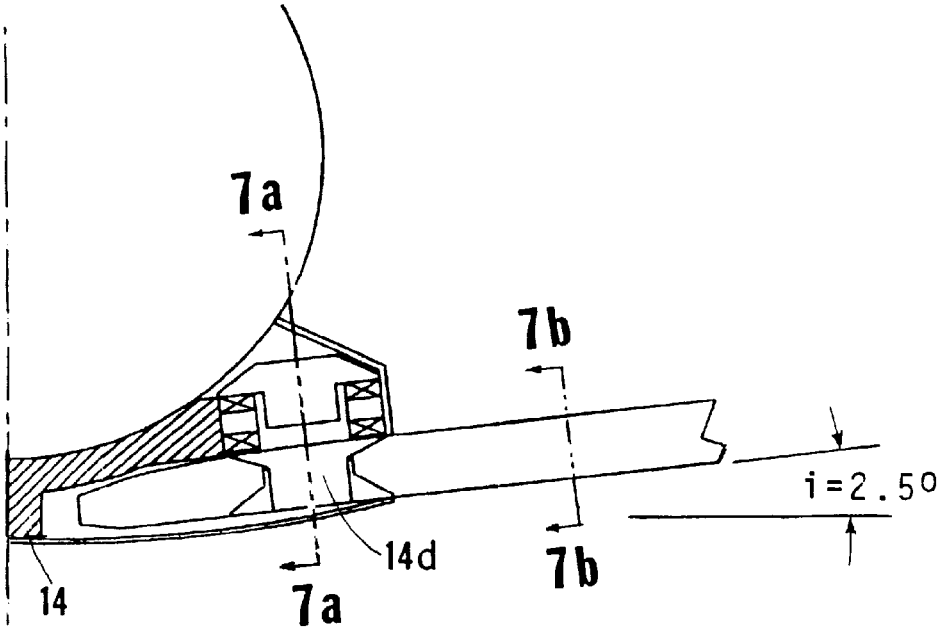
FIG. 7 is a cross sectional view of a portion of the hardback member of a second embodiment of the invention.
Figure 7A:
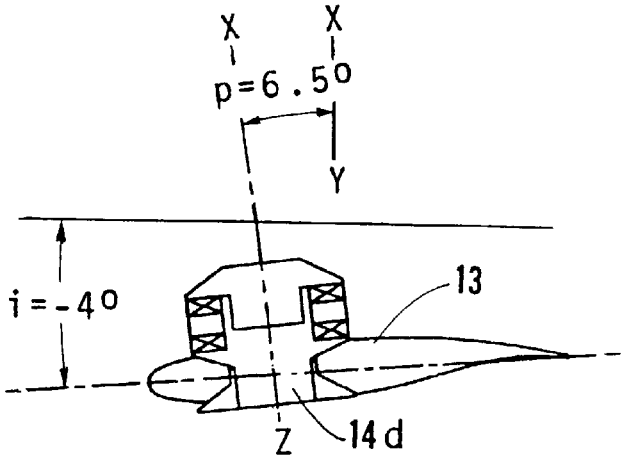
FIG. 7*a* is a cross sectional view taken along the plane indicated by 7*a*—7*a* in FIG. 7.
Figure 7B:
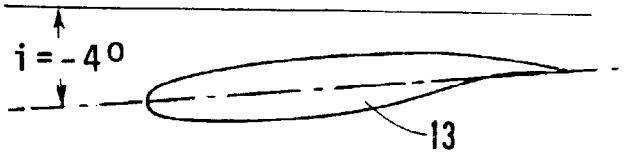
FIG. 7*b* is view taken along the plane indicated by 7*b*—7*b* in FIG. 7.

Referring now to FIGS. 7,7*a* and 7*b*, a second embodiment of the invention is illustrated. The second embodiment is the same as the first except that the wing pivot axis is tilted forward by a sufficient angle to change the extended wing incidence angle to a negative value. This tilt angle, "p" is typically 6.5 degrees, as shown in FIG. 7*a* which results in a wing incidence angle "i" of −4 degrees, as shown in FIGS. 7*a* and 7*b*. This also has a beneficial effect on the dihedral angle "d", for example reducing a 12 degree angle to about 6 degrees which itself is nearly completely offset by the −4 degrees of aerodynamic dihedral associated with a low wing configuration. In addition, the portion of the wing root inboard of the pivot is bent to ensure adequate clearance for the hardback member.

Figure 8:
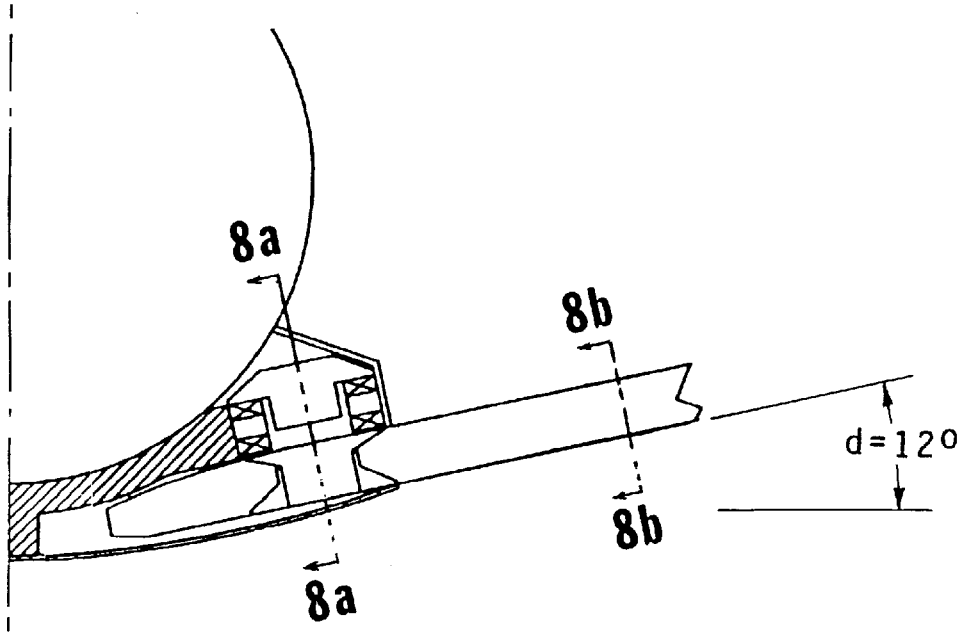
FIG. 8 is a cross sectional view of a portion of the hardback member of a third embodiment of the invention.
Figure 8A:
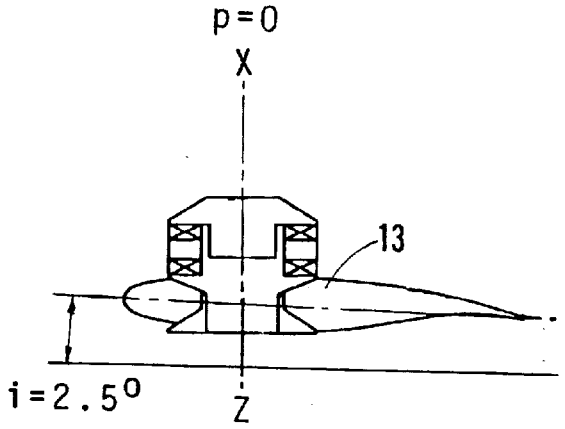
FIG. 8*a* is a cross sectional view taken along the plane indicated by 8*a*—8*a* in FIG. 8.
Figure 8B:
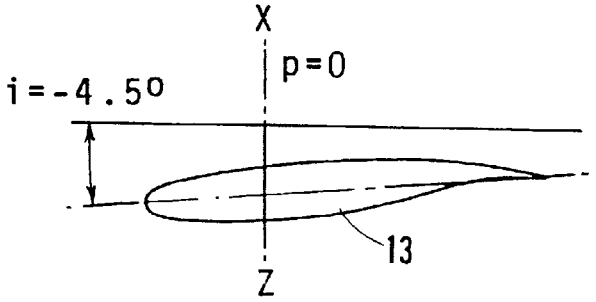
FIG. 8*b* is a view taken along the plane indicated by 8*b*—8*b* in FIG. 8.
Figure 9:
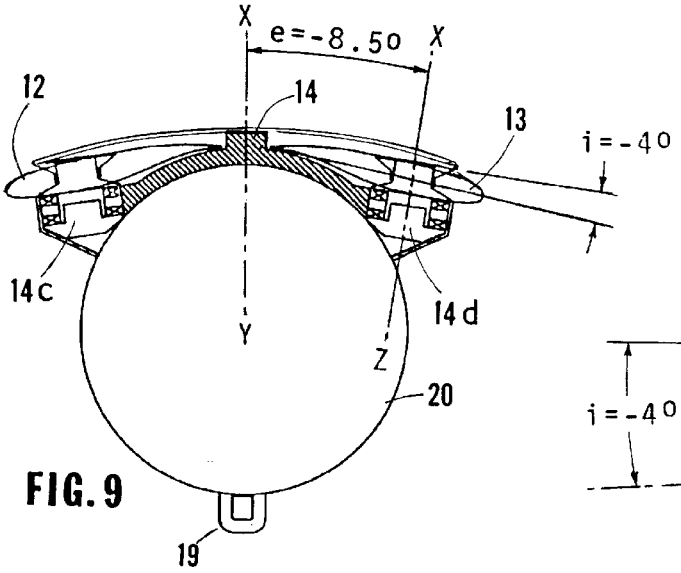
FIG. 9 is a cross sectional view of a fourth embodiment of the invention.
Figure 9B:
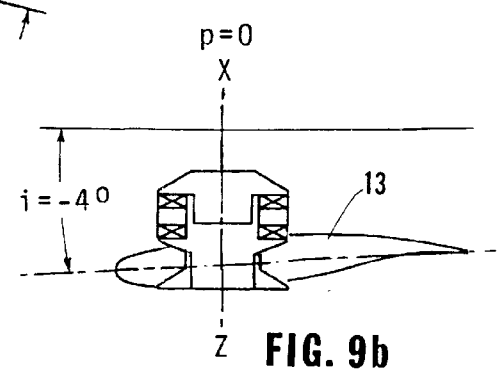
FIG. 9*b* is a cross sectional view taken along the plane indicated by 9*b*—9*b* in FIG. 9*a*.
Figure 9A:
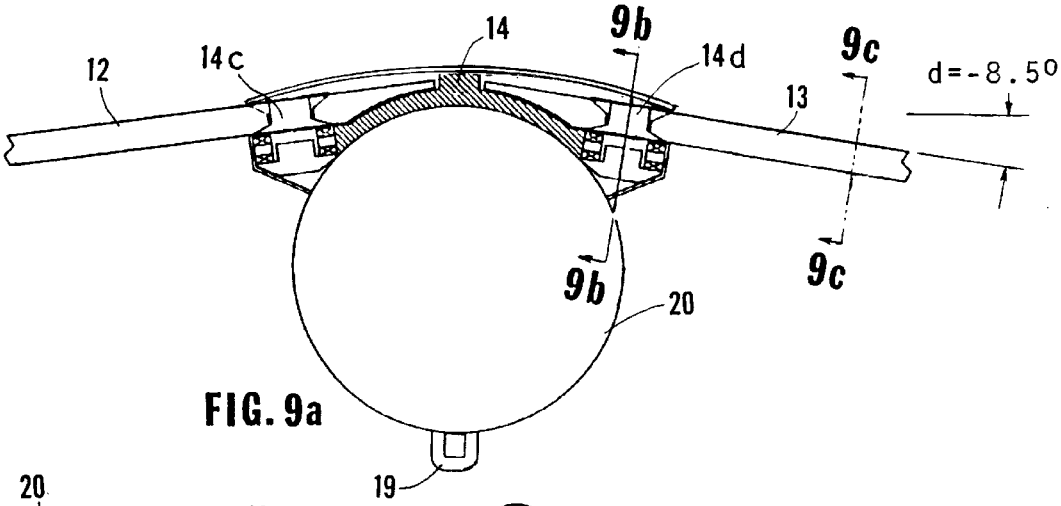
FIG. 9*a* is a cross sectional view of the embodiment of FIG. 9 with the wings of the device extended.

Referring now to FIGS. 8, 8*a* and 8*b*, a further embodiment of the invention is illustrated. This embodiment is the same as the first except that the wing 13 is twisted about its longitudinal axis relative to the X-Z axis by an angle of about 6.5 degrees to produce an angle of attack of about −4 degrees for the airfoil with the wings extended when the body angle of attack is zero.

Figure 10:
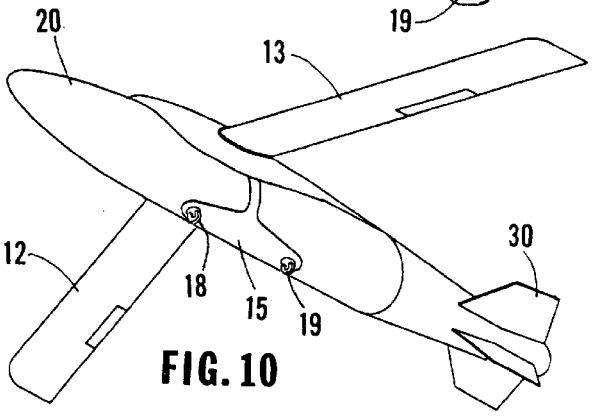
FIG. 10 is a bottom perspective view of the fourth embodiment attached to a bomb with its wings extended ready for flight.
Figure 9C:
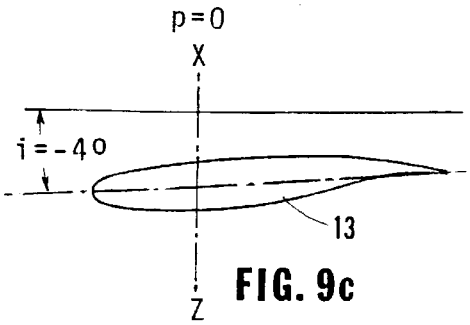
FIG. 9*c* is a cross sectional view taken along the plane indicated by 9*c*—9*c* in FIG. 9*a*.

Referring now to FIGS. 9, 9*a*, 9*b*, and 9*c* a still further embodiment of the invention is illustrated. This embodiment is the same as the first except that the wings are attached to the hardback member in an inverted configuration. This permits the dihedral angle(d) which is equal to the angle(e) to be about −8.5 degrees with the angle(i) about −4 degrees. Since the weapon cannot fly efficiently with inverted wings, the tail fins 30 of the bomb are used to roll the weapon 180 degrees immediately after launch. The weapon is shown in FIG. 10 after it is launched. This results in a high wing configuration what satisfies the bomb's terminal requirements without excessive dihedral angle.

Referring now to FIG. 6, the angle "e" will typically lie in the range of 6–14 degrees, depending on the shape of the airfoil. The wing chord cannot exceed about 13 inches without resulting in inadequate spacing in the rotary launcher between adjacent bombs. Good performance will be obtained with a suitable combination of these parameters within the specified ranges.

While the invention has been described and illustrated in detail this is not to be taken by way of limitation, the scope of the invention being determined by the following claims.

We claim:

1. In a guided bomb system having a bomb with at least one suspension lug thereon, a device for mounting wings on said bomb comprising:

a hardback member, said wings being pivotally supported on said hardback member, the angle between the vertical axis of the hardback member and the pivot axes of said wings being 8–12 degrees, a saddle member running around said bomb, said saddle member engaging the suspension lug of said bomb to prevent movement thereof relative to said bomb, said saddle member being attached at its opposite ends to said hardback member, means for securely clamping said saddle member to said hardback member thereby securing said saddle member to said bomb, and means for driving said wings from a retracted position adjacent to said hardback member to and extending position extending outwardly away from said hardback member.

2. The system of claim 1 wherein said bomb and said device are mounted on a rotary launcher within an aircraft.

3. The system of claim 2 wherein said bomb is mounted in said launcher such that when the bomb is launched the wings are upside down after which the bomb is inverted causing the wings to be in a predetermined optimum orientation for flight.

4. The system of claim 1 wherein said clamping means comprises a tensioning bolt for drawing said hardback member and said saddle member together.

5. The system of claim 1 wherein said saddle member has a cutout formed therein through which the lug on said bomb is snugly fitted.

6. The system of claim 1 wherein said means for driving said wings to the extended position comprises a linkage pivotally attached one end thereof to said wings, and means for driving said linkage against said wings.

7. The system of claim 1 wherein the pivotal axes about which said wings pivot relative to said hardback member run normal to the longitudinal axis of said bomb.

8. The system of claim 1 wherein the pivotal axes about which said wings pivot relative to said hardback member are tilted at about a 6.5 degree angle relative to an axis normal to the longitudinal axis of said bomb.

9. A bomb and a system for guiding the flight of said bomb, said system and said bomb being mounted in a rotary launcher, said system comprising, a hardback member extending longitudinally along a surface of said bomb, a saddle member for removably attaching said hardback member to said bomb, said saddle member running circumferentialy around a surface portion of said bomb, the opposite ends of said saddle member being connected o said hardback member, means for tightening said saddle member to said hardback member to bring said saddle member and hardback member into clamping engagement with said bomb, a pair of wings pivotally supported on said hardback member in opposing relationship, and means for driving the wings from a retracted position along a surface of said hardback member to an extended position outward away from said bomb, the angle between the divot axes of said wings and the vertical axis of the hardback being 8–12 degrees with the wings retracted.

10. The system of claim 9 wherein said bomb is mounted in said launcher such that when the bomb is launched the wings are upside down, after which the bomb is inverted causing the wings to be in a predetermined optimum orientation for flight.

11. The system of claim 9 wherein the pivot axes of said wings is tilted by about 6.5 degrees relative to an axis normal to the longitudinal axis of said bomb.

12. The system of claim 9 wherein said wings are twisted by a predetermined angle about their longitudinal axes.

* * * * *